US011680537B2

(12) United States Patent
Ohira et al.

(10) Patent No.: US 11,680,537 B2
(45) Date of Patent: Jun. 20, 2023

(54) CYLINDER LINER AND CYLINDER BORE

(71) Applicants: TPR Co., Ltd., Tokyo (JP); TPR Industry Co., Ltd., Yamagata (JP)

(72) Inventors: Masayuki Ohira, Tokyo (JP); Naoki Umeda, Tokyo (JP); Seiji Tamaki, Tokyo (JP); Takashi Sato, Yamagata (JP); Takashi Oizumi, Yamagata (JP)

(73) Assignees: TPR Co., Ltd., Tokyo (JP); IPR Industry Co., Ltd., Yamagata (JP)

( * ) Notice: Subject to any disclaimer, the term of this patent is extended or adjusted under 35 U.S.C. 154(b) by 0 days.

(21) Appl. No.: 17/770,749

(22) PCT Filed: Nov. 6, 2019

(86) PCT No.: PCT/JP2019/043532
§ 371 (c)(1),
(2) Date: Apr. 21, 2022

(87) PCT Pub. No.: WO2021/090410
PCT Pub. Date: May 14, 2021

(65) Prior Publication Data

US 2022/0372929 A1 Nov. 24, 2022

(51) Int. Cl.
*F02F 1/00* (2006.01)
*F02F 1/20* (2006.01)

(52) U.S. Cl.
CPC ..... *F02F 1/004* (2013.01)

(58) Field of Classification Search
CPC ..... F02F 1/004; F02F 1/20; F02F 2200/06; F16J 10/04
See application file for complete search history.

(56) References Cited

U.S. PATENT DOCUMENTS

| | | | | |
|---|---|---|---|---|
| 9,581,103 | B1 * | 2/2017 | Qin | C22C 38/16 |
| 9,915,220 | B2 * | 3/2018 | Meirelles Tomanik | F02F 1/20 |
| 10,760,525 | B2 * | 9/2020 | Kaneko | F02F 1/00 |
| 10,961,947 | B2 * | 3/2021 | Gaiselmann | F02F 1/20 |
| 2002/0148430 | A1 | 10/2002 | Kano et al. | |

(Continued)

FOREIGN PATENT DOCUMENTS

| | | | |
|---|---|---|---|
| CN | 103998755 | A | 8/2014 |
| CN | 204283637 | U | 4/2015 |

(Continued)

OTHER PUBLICATIONS

First Office Action in CN Application No. 201911147301.6 dated Apr. 21, 2021, 20 pages.

(Continued)

*Primary Examiner* — Grant Moubry
(74) *Attorney, Agent, or Firm* — Marshall, Gerstein & Borun LLP

(57) ABSTRACT

The present invention addresses the problem of providing a cylinder liner or a cylinder bore, which can reduce not only friction on a sliding surface but also oil consumption. In a piston sliding direction of the cylinder bore, grooves of a second sliding region positioned on the side of crankcase have a higher groove area ratio at a depth of 0.3 μm than grooves of a first sliding region positioned on the side of combustion chamber, and the groove area ratio is in a specific range, whereby friction and oil consumption can be reduced.

12 Claims, 3 Drawing Sheets

(56) References Cited

U.S. PATENT DOCUMENTS

| | | | | |
|---|---|---|---|---|
| 2004/0226402 | A1* | 11/2004 | Fuchs | F16J 10/04 74/828 |
| 2014/0345453 | A1 | 11/2014 | Oh et al. | |
| 2015/0192063 | A1* | 7/2015 | Chang | F02F 1/20 123/193.2 |
| 2017/0167430 | A1* | 6/2017 | Bettini Rabello | F02F 1/16 |
| 2020/0256277 | A1 | 8/2020 | Kawai et al. | |

FOREIGN PATENT DOCUMENTS

| | | | |
|---|---|---|---|
| CN | 208215084 | U | 12/2018 |
| CN | 211598839 | U | 9/2020 |
| JP | 2002-235852 | A | 8/2002 |
| JP | 2010-054045 | A | 3/2010 |
| JP | 2012-012957 | A | 1/2012 |
| JP | 2017-067271 | A | 4/2017 |
| JP | 2017-110804 | A | 6/2017 |
| JP | 6533858 | B1 | 6/2019 |
| JP | 2019-120185 | A | 7/2019 |

OTHER PUBLICATIONS

Second Office Action in CN Application No. 201911147301.6 dated Oct. 22, 2021, 10 pages.

Search Report in International Application No. PCT/JP2019/043532 dated Jan. 21, 2020, 2 pages.

First Office Action in JP Application No. 201911147301.6 dated Apr. 21, 2021, 20 pages.

Second Office Action in JP Application No. 201911147301.6 dated Oct. 22, 2021, 10 pages.

Office Action in JP Application No. 2021-554476 dated Mar. 14, 2023, 7 pages.

* cited by examiner

CYLINDER LINER AND CYLINDER BORE

TECHNICAL FIELD

The present invention relates to a cylinder liner and a cylinder bore that are used in an internal combustion engine.

BACKGROUND ART

Grooves and the like are microfabricated on the inner walls (cylinder bores) of cylinders in order to reduce friction during sliding with pistons.

For example, Patent Document 1, which is aimed at providing a low friction sliding member that can reduce the friction loss in a stroke middle section without causing oil deficiency at stroke ends, proposes a low friction sliding member in which a smooth surface formed on a sliding surface has fine recesses with regularly varying depth, and plateau-like projections are formed between the recesses.

Further, Patent Document 2 discloses a cylinder block in which, in order to reduce scuffing that may be caused by formation of grooves on a sliding surface, the surface roughness of the sliding surface and the depth of the grooves are controlled in certain ranges, and opening edges of the grooves are provided with curved surfaces.

RELATED ART DOCUMENTS

Patent Documents

[Patent Document 1] Japanese Unexamined Patent Application Publication No. 2002-235852

[Patent Document 2] Japanese Unexamined Patent Application Publication No. 2017-67271

SUMMARY OF THE INVENTION

Problems to be Solved by the Invention

An object of the present invention is to provide a cylinder liner and a cylinder bore that can reduce not only friction on a sliding surface but also oil consumption, based on a technology different from those proposed in the above-described Patent Documents.

Means for Solving the Problems

The present inventors conducted studies to solve the above-described problem and consequently obtained a finding that, in the piston sliding direction of a cylinder bore, the sliding environment is different between a region on the side of a combustion chamber and a region on the side of a crankcase. In other words, the present inventors found that a region of a cylinder bore on the side of a combustion chamber has a sliding environment where a lubricating oil exists in a small amount and boundary lubrication is dominant, whereas a region of the cylinder bore on the side of a crankcase has a sliding environment where a lubricating oil exists in relative abundance and fluid lubrication is dominant. Based on this finding, the present inventors discovered that not only friction on a sliding surface but also oil consumption can be reduced by allowing a cylinder bore to have appropriate surface properties in accordance with the respective regions of the cylinder bore, thereby completing the present invention.

One embodiment of the present invention is a cast iron cylinder liner used in an internal combustion engine, wherein plural grooves are formed on a cylinder bore of the cylinder liner, the cylinder bore includes, in a piston sliding direction, a first sliding region and a second sliding region that are different in properties of the grooves, the first sliding region is positioned on the side of a combustion chamber relative to the second sliding region, and the first sliding region has a groove area ratio of 10% or lower while the second sliding region has a groove area ratio of 15% to 40%.

It is noted here that the groove area ratio is a ratio of groove area at a depth of 0.3 μm from the cylinder bore surface.

Another embodiment of the present invention is a cylinder bore of an internal combustion engine, wherein plural grooves are formed on the cylinder bore, the cylinder bore includes, in a piston sliding direction, a first sliding region and a second sliding region that are different in properties of the grooves, the first sliding region is positioned on the side of a combustion chamber relative to the second sliding region, and the first sliding region has a groove area ratio of 10% or lower while the second sliding region has a groove area ratio of 15% to 40%.

The groove area ratio is a ratio of groove area at a depth of 0.3 μm from the cylinder bore surface.

The above-described internal combustion engine is preferably a diesel internal combustion engine. Further, it is preferred that the first sliding region and the second sliding region constitute a continuous region, and that a boundary of these regions exist in a crank angle range of 50° to 80°.

A mode in which the groove area ratio of the second sliding region is 18% to 36% is preferred.

Regarding the surface roughness, the second sliding region preferably has an Ra of 0.13 μm to 0.45 μm, an Rk of 0.36 μm to 0.8 μm and an Rk of 0.20 μm to 0.27 μm.

Effects of the Invention

According to the present invention, a cylinder liner and a cylinder bore, which can reduce not only friction on a sliding surface but also oil consumption, can be provided. That is, the present invention can provide a cylinder liner and a cylinder bore, with which an internal combustion engine having both a low fuel consumption and a low oil consumption can be achieved. In diesel internal combustion engines, a two-piece ring is often used as an oil ring, and the oil ring has a flat sliding surface in such cases; therefore, a reduction in the friction in a fluid lubrication region, which is associated with an increase in the oil film thickness of a sliding portion by a wedge effect, cannot be expected. Thus, in the present invention, the groove area ratio is increased, and a reduction in the friction is thereby expected in association with a reduction in the sliding surface area in the fluid lubrication region, so that the present invention can be suitably applied to diesel internal combustion engines.

MODE FOR CARRYING OUT THE INVENTION

One embodiment of the present invention is a cast iron cylinder liner suitably used in a diesel internal combustion engine, and plural grooves are formed on a cylinder bore of the cylinder liner. Further, the cylinder bore includes, in a piston sliding direction, a first sliding region and a second sliding region that are different in properties of the grooves. Another embodiment of the present invention can be a cylinder bore. That is, another embodiment of the present invention may be a cylinder bore on which a cylinder liner is absent. Even in such a case, plural grooves are formed on the cylinder bore in the same manner. Further, this cylinder bore includes, in a piston sliding direction, a first sliding region and a second sliding region that are different in properties of the grooves. An embodiment that includes a cylinder liner will now be described referring to FIG. 1.

Figure 1:
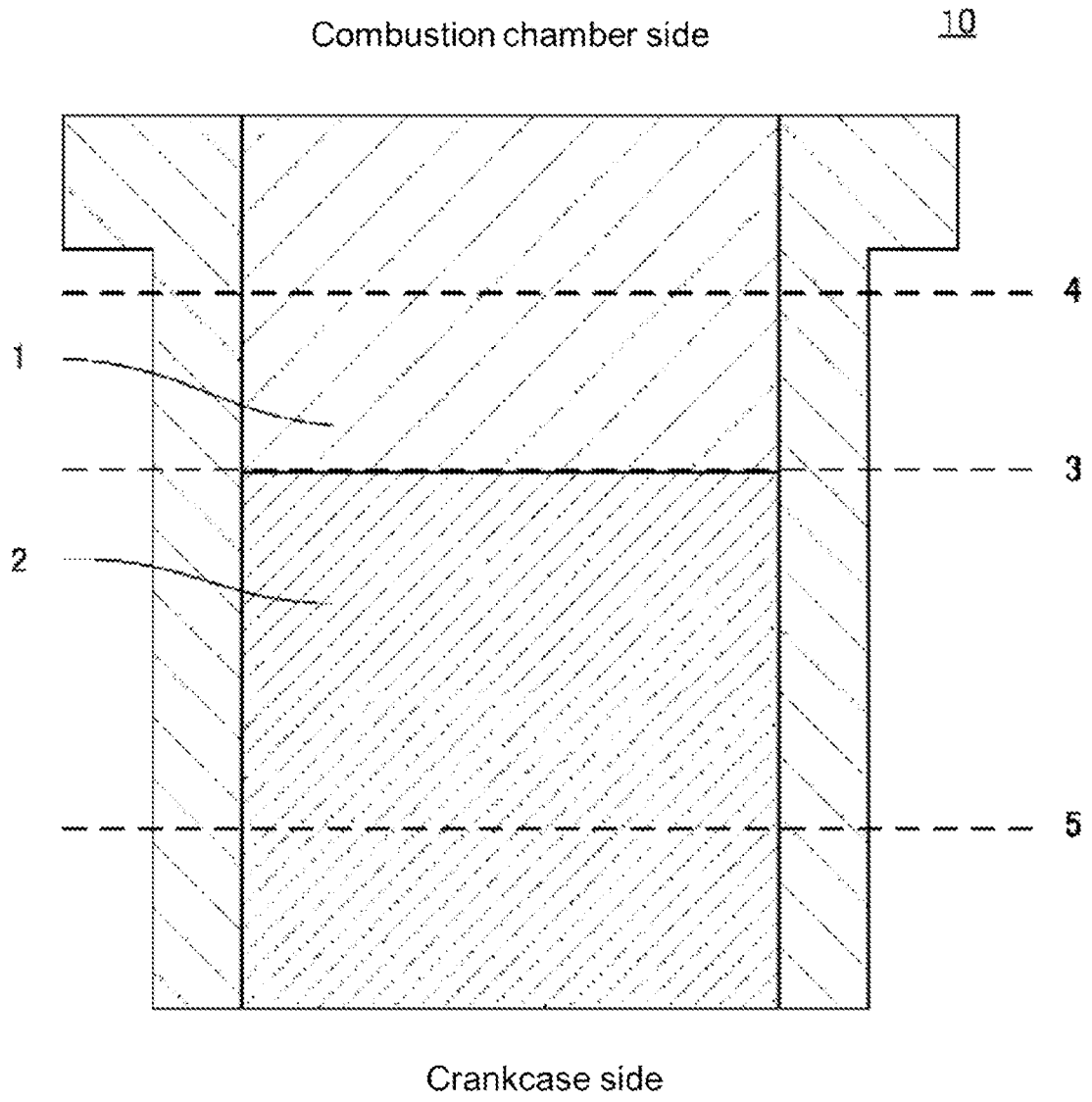
FIG. 1 is a schematic cross-sectional view of the cylinder liner according to the present embodiment.

FIG. 1 is a cross-sectional view of a cylinder liner. A cylinder liner 10 is typically a cylinder liner made of cast iron; however, the cylinder liner 10 may be formed of an aluminum alloy or a copper alloy.

The cylinder liner 10 is arranged in a cylinder block of an internal combustion engine, inside of which a piston slides in the vertical direction in FIG. 1.

In FIG. 1, a dashed line 4 represents a top dead center (TDC) of an oil ring while a dashed line 5 represents a bottom dead center (BDC) of the oil ring, and a cylinder bore includes: a first sliding region 1 that contains the top dead center 4; and a second sliding region 2 that contains the bottom dead center 5. The first sliding region 1 and the second sliding region 2 can constitute a continuous region via a boundary 3.

In the present embodiment, the groove area ratio of the second sliding region 2 is higher than that of the first sliding region 1. The first sliding region 1 may have a groove area ratio of 10% or lower, while the second sliding region 2 may have a groove area ratio of 15% to 40%. The groove area ratio will now be described referring to FIGS. 2 and 3.

Figure 2A:
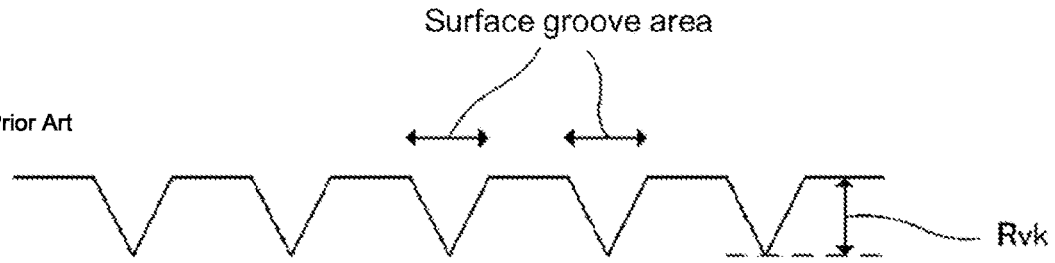
Fig. 2(a) Prior Art
FIGS. 2(*a*) and 2(*b*) are both cross-sectional views schematically illustrating the shape of grooves formed on a cylinder bore according to a prior art.
Figure 2B:
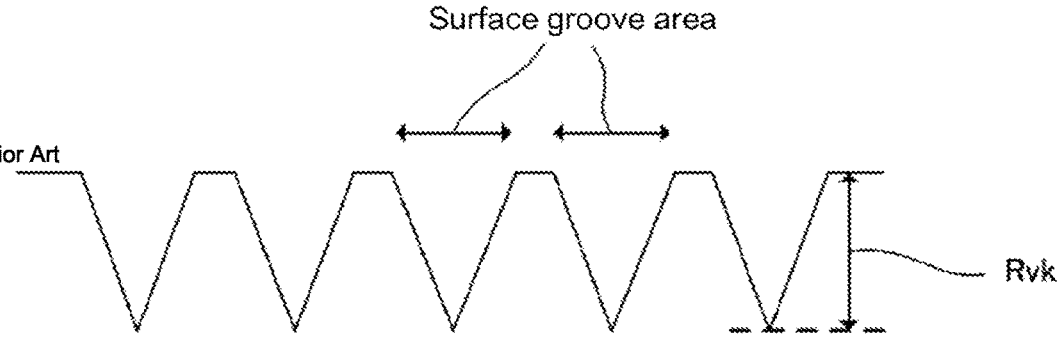
Fig. 2(b) Prior Art

FIG. 2 provides schematic drawings each illustrating a cross-section of grooves formed on a cylinder bore in a conventional embodiment. FIG. 2(*a*) illustrates one form of grooves on the cylinder bore surface, while FIG. 2(*b*) illustrates another form of grooves on the cylinder bore surface. Comparing FIGS. 2(*a*) and 2(*b*), the grooves are formed such that the groove area ratio on the cylinder bore surface is higher in FIG. 2(*b*). In FIG. 2(*b*), the groove area ratio is higher and, at the same time, the groove depth, i.e. Rvk value, is larger. In a general groove formation process, an increase in the groove area ratio leads to an increase in the Rvk value as well.

In the sliding environment of a region of the cylinder bore on the crankcase side, i.e. the second sliding region 2, a lubricating oil exists in relative abundance, making a fluid lubrication region dominant. As a result of examining methods of reducing the friction in the second sliding region dominated by the fluid lubrication region, the present inventors conceived of an idea that, by appropriately increasing the groove area ratio at a depth of 0.3 μm from the cylinder bore surface rather than the groove area ratio of the cylinder bore outermost surface, the oil film shear area in the fluid lubrication region is reduced, so that the friction can be reduced.

Figure 3:
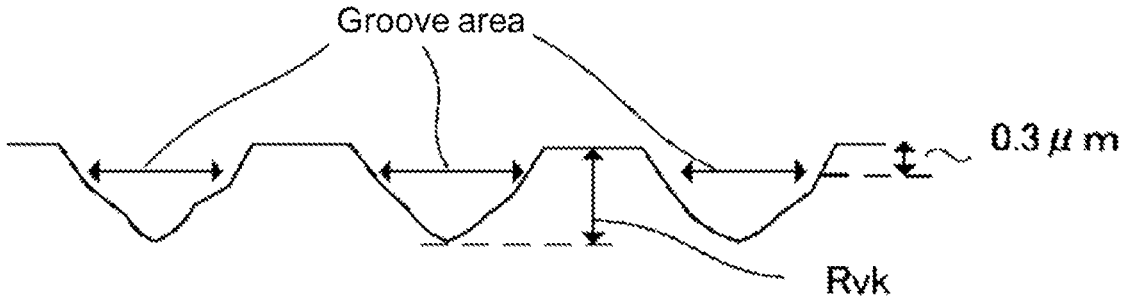
FIG. 3 is a cross-sectional view schematically illustrating the shape of the grooves formed on the cylinder bore according to the present embodiment.

FIG. 3 is a schematic drawing that illustrates a cross-section of the grooves formed on the cylinder bore according to the present embodiment. In the present embodiment, focus is given to the cylinder bore surface roughness and the ratio of grooves at a depth of 0.3 μm from the cylinder bore surface, and these values are each appropriately controlled to reduce the friction in the second sliding region, as a result of which oil consumption can be reduced. In other words, by controlling the groove area ratio, which is a proportion of grooves at a depth of 0.3 μm from the cylinder bore surface, to be higher in the second sliding region than in the first sliding region, the oil film shear area is reduced in the fluid lubrication region, so that the friction can be reduced. In a preferred mode, the first sliding region 1 satisfies an Ra value of 0.08 μm to 0.11 μm and an Rk value of 0.20 μm to 0.27 μm, and the second sliding region satisfies an Ra value of 0.13 μm to 0.45 μm, an Rk value of 0.36 μm to 0.82 μm, and an Rvk value of 0.35 μm to 1.22 μm.

Further, a difference between the groove area ratio of the first sliding region and that of the second sliding region may be 5% or more, 10% or more, or 15% or more. An upper limit of the difference may be 40% or less, or 35% or less.

In the second sliding region, by controlling the groove area ratio, which is a proportion of grooves at a depth of 0.3 μm from the cylinder bore surface, to be 15% or higher, the oil film shear area is reduced in the fluid lubrication region, so that the friction can be reduced. On the other hand, when the groove area ratio is higher than 40%, the LOC (lubricating oil consumption) cannot be reduced.

It is noted here that, even if the proportion of grooves is increased at a position shallower than 0.3 μm, the oil film shear area is not sufficiently reduced, and a friction-reducing effect is thus unlikely to be obtained. By measuring a depth of 0.3 μm, the noise caused by Rpk (initial wear height) can be eliminated.

The groove area ratio of the second sliding region is preferably 15% or higher and may be 18% or higher, but it is preferably 40% or lower and may be 36% or lower.

The groove area ratios of the first and the second sliding regions are ratios of groove area at a depth of 0.3 μm from the cylinder bore surface and determined by the below-described procedure. In addition, the definition of the cylinder bore surface serving as a reference is described below.

First, a replica (2 cm×2 cm) of the cylinder bore surface is prepared using RepliSet F1 or F5 manufactured by Struers Inc. This replica is preferably prepared for at least two opposing spots of the cylinder bore. The thus prepared replica is observed using a ×50 objective lens under a shape analysis laser microscope manufactured by KEYENCE Corporation (VK-X150). Subsequently, tilt correction and inversion (since the protruding parts of the replica correspond to the grooves of the cylinder bore) of the observed data are performed using an observation software "VK Analyzer". From the inverted data, a "height histogram" is extracted by "volume/area analysis", and a modal position thereof is taken as a threshold value and defined as "cylinder bore surface". Further, a ratio of the groove area at a depth of 0.3 μm from the surface in the observed region is defined as "groove area ratio". The groove area ratio is desirably of the cylinder bore outermost surface (position at which actual grooves have the smallest inner diameter); however, considering the variation in the data (effect of Rpk component), the measurement position is set at a depth of 0.3 μm from the cylinder bore surface. It is noted here that the groove area ratio is determined as an average value of 10 points measured at each of two opposing spots of the cylinder bore.

The Ra of the second sliding region on the cylinder bore surface is preferably 0.13 μm or more and may be 0.15 μm or more, but it is preferably 0.45 μm or less and may be 0.38 μm or less. When the Ra is 0.13 μm to 0.45 μm, not only the LOC (lubricating oil consumption) can be reduced, but also the generation of scuffs can be inhibited.

The Rk of the second sliding region on the cylinder bore surface is preferably 0.36 μm or more and may be 0.37 μm or more, but it is preferably 0.82 μm or less and may be 0.73 μm or less. When the Rk is 0.36 μm to 0.82 μm, not only the LOC (lubricating oil consumption) can be reduced, but also the generation of scuffs can be inhibited.

The Rvk of the second sliding region on the cylinder bore surface is preferably 0.35 μm or more and may be 0.37 μm or more, but it is preferably 1.22 μm or less and may be 1.02 μm or less. When the Rvk is 0.35 μm to 1.22 μm, an increase in the LOC (lubricating oil consumption) caused by an increase in the friction can be inhibited.

The cylinder bore includes, in a piston sliding direction, the first sliding region and the second sliding region that are different in the above-described groove properties, and it is preferred that the first sliding region and the second sliding region be continuous, in which case a boundary of these regions preferably exists in an oil ring crank angle range of 50° to 80°. When the boundary exists in this crank angle range, the cylinder bore has a high wall temperature and this causes a reduction in the groove area ratio in the first sliding region where oil consumption due to evaporation of oil is high, as a result of which an oil consumption reducing effect is exerted more prominently.

It is noted here that the term "crank angle" means an engine rotation angle based on a top dead center of a piston (0°).

The first sliding region according to the present embodiment is not particularly restricted as long as the second sliding region satisfies the above-described groove area ratio; however, the first sliding region preferably has a groove area ratio of 10% or lower. The first sliding region is different from the second sliding region in that it is dominated by boundary lubrication, and it is preferred to reduce the frictional force generated by solid contact by reducing the groove area ratio and/or the surface roughness.

Further, the first sliding region is different from the second sliding region in that, due to its proximity to a combustion chamber, oil tends to be heated to cause an increase in the LOC. Therefore, it is preferred to reduce the amount of oil evaporation from the cylinder bore surface by reducing the groove area ratio and/or the surface roughness.

The Ra of the first sliding region on the cylinder bore surface may be 0.08 μm or more but 0.11 μm or less. When the Ra is 0.08 μm to 0.11 μm, the LOC (lubricating oil consumption) can be reduced.

The Rk of the first sliding region on the cylinder bore surface may be 0.20 μm or more but 0.27 μm or less. When the Rk is 0.20 μm to 0.27 μm, the LOC (lubricating oil consumption) can be reduced.

The cylinder bore of the cylinder liner according to the present embodiment can be produced by changing a honing process between the first sliding region and the second sliding region and appropriately adjusting the number of honing processes and the shape, the type, the particle size and the like of a grindstone used in the honing processes.

A crosshatch may be formed on the cylinder bore by a honing process. When a crosshatch is formed, the angle thereof (acute angle) is preferably 2° or larger and may be 5° or larger, or 10° or larger, but it is usually 60° or smaller and may be 45° or smaller, 30° or smaller, or 15° or smaller.

One example of the processing steps of the cylinder bore of the cylinder liner according to the present embodiment will now be described.

After the cylinder liner is produced by casting, the dimensions of its cylinder bore surface is processed to the neighborhood of final dimensions by sequentially performing rough boring, fine boring, honing I, and honing II. Subsequently, honing steps of honing III, honing IV, and honing V are preformed to form a prescribed surface roughness. The first sliding region is processed by the honing III, while the second sliding region is processed by the honing IV. For the honing III, a grindstone having a smaller particle size than the one used for the IV honing is used.

The above represents a case where the cylinder bore of the cylinder liner is left as a base material and, when the cylinder bore is subjected to a chemical conversion treatment such as phosphate coating, the step of applying a coating film may be added before the final processing step of honing.

In addition, other step may be added as appropriate depending on the limitations of a control system of a honing machine, or a processing step may be omitted in the case of employing a honing machine capable of various controls.

It is noted here that a cylinder bore on which a cylinder liner is not arranged can also be processed in the same manner as a cylinder bore of a cylinder liner.

EXAMPLES

The present invention will now be described in more detail by way of Examples; however, the present invention is not limited only to the below-described Examples.

Cylinder liners of inner diameter φ100 class were prepared from a cast iron material. The cylinder bore of each cylinder liner was honed to obtain cylinder liners having the respective groove area ratios shown in Table 1. Subsequently, for a real machine test, each cylinder liner was fitted to an actual engine. In the cylinder bore, the boundary of an upper portion (combustion chamber side) and a lower portion (crankcase side) had an oil ring crank angle of 65°.

TABLE 1

| Example/ Comparative Example | Groove area ratio of first sliding region [%] | Grooves of first sliding region Ra [μm] | Grooves of first sliding region Rk [μm] | Groove area ratio of second sliding region [%] | Grooves of second sliding region Ra [μm] | Grooves of second sliding region Rk [μm] | Grooves of second sliding region Rvk [μm] | Difference in groove area ratio [%] |
|---|---|---|---|---|---|---|---|---|
| Comparative Example 1 | 5 | 0.08 | 0.20 | 10 | 0.11 | 0.29 | 0.25 | 5 |
| Comparative Example 2 | 2 | 0.07 | 0.14 | 13 | 0.12 | 0.33 | 0.32 | 11 |
| Example 1 | 5 | 0.08 | 0.20 | 15 | 0.13 | 0.36 | 0.35 | 10 |
| Example 2 | 5 | 0.08 | 0.20 | 36 | 0.38 | 0.73 | 1.02 | 31 |

TABLE 1-continued

| Example/ Comparative Example | Groove area ratio of first sliding region [%] | Grooves of first sliding region Ra [μm] | Grooves of first sliding region Rk [μm] | Groove area ratio of second sliding region [%] | Grooves of second sliding region Ra [μm] | Grooves of second sliding region Rk [μm] | Grooves of second sliding region Rvk [μm] | Difference in groove area ratio [%] |
|---|---|---|---|---|---|---|---|---|
| Comparative Example 3 | 5 | 0.08 | 0.20 | 55 | 0.78 | 1.15 | 2.20 | 50 |
| Example 3 | 10 | 0.11 | 0.27 | 18 | 0.15 | 0.37 | 0.37 | 8 |
| Example 4 | 10 | 0.11 | 0.27 | 40 | 0.45 | 0.82 | 1.22 | 30 |
| Comparative Example 4 | 10 | 0.11 | 0.27 | 50 | 0.66 | 1.05 | 1.79 | 40 |
| Comparative Example 5 | 10 | 0.11 | 0.27 | 60 | 0.91 | 1.25 | 2.50 | 50 |
| Comparative Example 6 | 10 | 0.11 | 0.27 | 10 | 0.11 | 0.29 | 0.25 | 0 |
| Comparative Example 7 | 15 | 0.13 | 0.38 | 15 | 0.13 | 0.35 | 0.35 | 0 |
| Comparative Example 8 | 30 | 0.29 | 0.65 | 30 | 0.29 | 0.65 | 0.75 | 0 |
| Comparative Example 9 | 15 | 0.13 | 0.38 | 35 | 0.38 | 0.70 | 1.00 | 20 |
| Comparative Example 10 | 20 | 0.18 | 0.47 | 15 | 0.13 | 0.35 | 0.35 | 5 |

Real machine evaluation was conducted using each of the above-obtained cylinder liners of Examples 1 to 4 and Comparative Examples 1 to 10 and a piston fitted with the below-described piston rings. The operating conditions in the real machine evaluation and the evaluation criteria were as described below. The results are shown in Table 2.

Piston Rings

Of the piston rings used in the test, as a top ring, a ring having a width (dimension in the axial direction of cylinder) of 3.0 mm and a barrel-shaped outer peripheral surface, in which a material equivalent to JIS SUS440B was used as a base material and whose outer peripheral surface was coated with CrN by an arc ion plating method, was used. The top ring tension had a bore diameter ratio of 0.22 (N/mm).

As a second ring, a ring having a width (dimension in the axial direction of cylinder) of 3.0 mm and a taper-shaped outer peripheral surface, in which a material equivalent to FC250 was used as a base material and whose outer peripheral surface was plated with hard Cr, was used. The second ring tension had a bore diameter ratio of 0.25 (N/mm).

As a combined oil ring, a ring having a combined width (h) of 2.5 mm, in which a material equivalent to JIS SUS420J2 was used as a base material and whose outer peripheral surface was nitrided, was used. The oil ring tension had a bore diameter ratio of 0.30 (N/mm).

Regarding Method of Oil Consumption Measurement Test

Next, an oil consumption measurement test that was conducted using the cylinder liner of the present embodiment will be described. In the oil consumption measurement test, an engine of bore diameter φ100-mm class was used. After a run-in operation of the engine, with the load condition being in a full-load state, the coolant temperature and the engine oil temperature were set at 95° C. and 105° C., respectively, and a 10W-30 engine oil (grade: JASO standard, viscosity class: SAE J300) was used. Then, the oil consumption (LOC: lubrication oil consumption) was evaluated at an average piston velocity of the engine, V, of 8.3 m/s. The average piston velocity is an average velocity determined from the rotation speed and the stroke of the engine. The oil consumption was determined by an extraction method where the oil consumption is calculated from a difference in oil total weight before and after the evaluation.

Regarding Method of Fuel Consumption Test

Next, a fuel consumption test that was conducted using the cylinder liner of the present embodiment will be described. In the fuel consumption test, an engine of bore diameter φ100-mm class was used. After a run-in operation of the engine, with the load condition being in a full-load state, the coolant temperature and the engine oil temperature were set at 95° C. and 105° C., respectively, and a 10W-30 engine oil (grade: JASO standard, viscosity class: SAE J300) was used. Then, the amount of used fuel and the actual torque were measured in a V range of 3.3 to 9.2 m/s where V was defined as an average piston velocity of the engine, and the fuel consumption was calculated from the thus measured amount of used fuel and actual torque. The average piston velocity is an average velocity determined from the rotation speed and the stroke of the engine.

Regarding Method of Scuffing Test

Next, a scuffing test that was conducted using the cylinder liner of the present embodiment will be described. In the scuffing test, an engine of bore diameter φ100-mm class was used. After a run-in operation of the engine, with the load condition being in a full-load state, the coolant temperature was set at 120° C. while the engine oil temperature was left as is, and a 10W-30 engine oil (grade: JASO standard, viscosity class: SAE J300) was used. Then, scuffing was evaluated at an average piston velocity of the engine, V, of 8.3 m/s. The average piston velocity is an average velocity determined from the rotation speed and the stroke of the engine.

Evaluation Criteria

Fuel Consumption Test

◎: The fuel consumption was improved by 0.5% or more from the base ratio.

○: The fuel consumption was improved by more than 0% but less than 0.5% from the base ratio.

Δ: The fuel consumption was worsened by 0% to less than 0.5% from the base ratio.

x: The fuel consumption was worsened by 0.5% or more from the base ratio.

Scuffing Test (Visual Verification)

○: No scuff was observed.

x: Scuffs were generated.

Oil Consumption Test

◎: The oil consumption was improved by 10% or more from the base ratio.

○: The oil consumption was improved by more than 0% but less than 10% from the base ratio.

Δ: The oil consumption was worsened by 0% to less than 10% from the base ratio.

x: The oil consumption was worsened by 10% or more from the base ratio.

It is noted here that, as a base, a cylinder bore having a groove area ratio of about 18% in both the first sliding region and the second sliding region was used.

TABLE 2

| Example/ Comparative Example | Fuel efficiency | Scuffing | Oil consumption |
|---|---|---|---|
| Comparative Example 1 | X | ○ | ◎ |
| Comparative Example 2 | Δ | ○ | ◎ |
| Example 1 | ○ | ○ | ◎ |
| Example 2 | ◎ | ○ | ◎ |
| Comparative Example 3 | Δ | ○ | X |
| Example 3 | ○ | ○ | ◎ |
| Example 4 | ○ | ○ | ○ |
| Comparative Example 4 | Δ | ○ | Δ |
| Comparative Example 5 | X | ○ | X |
| Comparative Example 6 | X | ○ | ◎ |
| Comparative Example 7 | Δ | ○ | Δ |
| Comparative Example 8 | ○ | ○ | X |
| Comparative Example 9 | ○ | ○ | Δ |
| Comparative Example 10 | Δ | ○ | Δ |

Next, using the cylinder liner of Example 2, real machine evaluation was conducted with varying oil ring crank angles. The operating conditions in the real machine evaluation and the evaluation criteria were the same as described above. The results are shown in Table 3.

TABLE 3

| Example/ Comparative Example | Crank angle [°] | Fuel efficiency | Scuffing | Oil consumption |
|---|---|---|---|---|
| Example 5 | 40 | ○~◎ | ○ | Δ |
| Example 6 | 50 | ○~◎ | ○ | ○ |
| Example 7 | 80 | ○ | ○ | ○ |
| Example 8 | 90 | Δ | ○ | ○ |

Next, a friction test was conducted to verify the relationship between the groove area ratio of the cylinder bore and friction. The friction test was conducted by the below-described procedure while changing the groove area ratio without changing the surface roughness of the cylinder bore. The results are shown in Table 4. From the results shown in Table 4, it can be understood that, by controlling the groove area ratio to be 15 to 50%, friction can be reduced in all of the cases where the rotation speed was changed in a range of 600 to 1,500 rpm.

Friction Test

The friction was evaluated by open-air motoring in a single-cylinder floating liner test (a test for determining the change in the friction of a piston and a piston ring in a single cycle). In this friction measurement test, a crank-type single-cylinder motoring tester (floating liner type) having a bore diameter of 83 mm and a stroke of 86 mm was used.

As for the test conditions, the coolant temperature and the engine oil temperature were both set at 80° C., a 10W-30 engine oil (grade: JASO standard, viscosity class: SAE J300) was used, and the evaluation rotation speed was set between 600 rpm and 2,000 rpm.

TABLE 4

| Example/ Comparative Example | Groove area ratio [%] | 600 rpm Friction | 1000 rpm Friction | 1500 rpm Friction |
|---|---|---|---|---|
| Comparative Example 11 | 10 | 1.09 | 1.16 | 1.08 |
| Example 9 | 15 | 1.00 | 1.00 | 1.00 |
| Example 10 | 30 | 0.94 | 0.92 | 0.94 |
| Example 11 | 35 | 0.92 | 0.94 | 0.89 |
| Comparative Example 12 | 50 | 0.93 | 1.04 | 0.86 |
| Comparative Example 13 | 60 | 0.98 | 1.23 | 0.85 |

DESCRIPTION OF SYMBOLS

10: cylinder liner
1: first sliding region
2: second sliding region
3: boundary
4: top dead center
5: bottom dead center

The invention claimed is:

1. A cast iron cylinder liner used in an internal combustion engine, wherein plural grooves are formed on a cylinder bore of the cylinder liner, the cylinder bore comprises, in a piston sliding direction, a first sliding region and a second sliding region that are different in properties of the grooves, the first sliding region is positioned on a side of a combustion chamber relative to the second sliding region, and the first sliding region has a groove area ratio of 10% or lower while the second sliding region has a groove area ratio of 15% to 40%, the groove area ratio being a ratio of groove area at a depth of 0.3 μm from a cylinder bore surface.

2. The cast iron cylinder liner according to claim 1, wherein the first sliding region and the second sliding region constitute a continuous region, and a boundary of these regions exists in a crank angle range of 50° to 80°.

3. The cast iron cylinder liner according to claim 1, wherein the groove area ratio of the second sliding region is 18% to 36%.

4. The cast iron cylinder liner according to claim 1, wherein the second sliding region has, regarding surface roughness, an Ra of 0.13 μm to 0.45 μm, an Rk of 0.36 μm to 0.82 μm, and an Rvk of 0.35 μm to 1.22 μm.

5. The cast iron cylinder liner according to claim 1, wherein the first sliding region has, regarding surface roughness, an Ra of 0.08 μm to 0.11 μm and an Rk of 0.20 μm to 0.27 μm.

6. The cast iron cylinder liner according to claim 1, wherein the internal combustion engine is a diesel internal combustion engine.

7. A cylinder bore of an internal combustion engine, wherein plural grooves are formed on a cylinder bore, the cylinder bore comprises, in a piston sliding direction, a first sliding region and a second sliding region that are different in properties of the grooves, the first sliding region is positioned on a side of a combustion chamber relative to the second sliding region, and the first sliding region has a groove area ratio of 10% or lower while the second sliding region has a groove area ratio of 15% to 40%, the groove area ratio being a ratio of groove area at a depth of 0.3 μm from a cylinder bore surface.

8. The cylinder bore according to claim 7, wherein the first sliding region and the second sliding region constitute a continuous region, and a boundary of these regions exists in a crank angle range of 50° to 80°.

9. The cylinder bore according to claim 7, wherein the groove area ratio of the second sliding region is 18% to 36%.

10. The cylinder bore according to claim 7, wherein the second sliding region has, regarding surface roughness, an Ra of 0.13 μm to 0.45 μm, an Rk of 0.36 μm to 0.82 μm, and an Rvk of 0.35 μm to 1.22 μm.

11. The cylinder bore according to claim 7, wherein the first sliding region has, regarding surface roughness, an Ra of 0.08 μm to 0.11 μm and an Rk of 0.20 μm to 0.27 μm.

12. The cylinder bore according to claim 7, wherein the internal combustion engine is a diesel internal combustion engine.

* * * * *